US009132056B2

(12) United States Patent
Westerlund

(10) Patent No.: US 9,132,056 B2
(45) Date of Patent: Sep. 15, 2015

(54) CRUTCH WITH WHEELS

(71) Applicant: Hans Westerlund, Strängnäs (SE)

(72) Inventor: Hans Westerlund, Strängnäs (SE)

(73) Assignee: HÄLSO OCH LASERSPECIALISTERNA MÄLARDALEN KB, Eskilstuna (SE)

( * ) Notice: Subject to any disclaimer, the term of this patent is extended or adjusted under 35 U.S.C. 154(b) by 0 days.

(21) Appl. No.: 14/349,957

(22) PCT Filed: Oct. 8, 2012

(86) PCT No.: PCT/SE2012/051075

§ 371 (c)(1),
(2) Date: Apr. 4, 2014

(87) PCT Pub. No.: WO2013/052003

PCT Pub. Date: Apr. 11, 2013

(65) Prior Publication Data

US 2014/0261592 A1 Sep. 18, 2014

(30) Foreign Application Priority Data

Oct. 6, 2011 (SE) ..... 1150924

(51) Int. Cl.
*A61H 3/04* (2006.01)
*A61H 3/02* (2006.01)
*A61H 3/00* (2006.01)

(52) U.S. Cl.
CPC .. *A61H 3/04* (2013.01); *A61H 3/02* (2013.01); *A61H 3/0288* (2013.01); *A61H 2003/002* (2013.01)

(58) Field of Classification Search
CPC ..... A61H 3/02; A61H 2003/0216; A61H 3/0288; A61H 3/04
USPC ..... 135/66, 68, 69, 75, 78, 85
See application file for complete search history.

(56) References Cited

U.S. PATENT DOCUMENTS 4,962,781 A 10/1990 Kanbar
5,188,138 A * 2/1993 Yamasaki et al. ..... 135/65

(Continued)

FOREIGN PATENT DOCUMENTS

DE 19951071 A1 5/2000
DE 202010016170 U1 * 3/2011
WO WO 2006039989 A1 * 4/2006
WO 2006121404 A1 11/2006
WO 2008043862 A1 4/2008

OTHER PUBLICATIONS

International Search Report corresponding to International Application No. PCT/SE2012/051075 mailed Dec. 17, 2012.

(Continued)

*Primary Examiner* — David R Dunn
*Assistant Examiner* — Danielle Jackson
(74) *Attorney, Agent, or Firm* — Polster, Lieder, Woodruff & Lucchesi, L.C.

(57) ABSTRACT

A crutch with wheels has a frame structure comprising a straight front frame part, a curved rear frame part and a strut extending between the straight front frame part and the curved rear frame part. A handle is provided in the upper part of the front frame part and a wheel is provided in the lower part of the front frame part. The upper part of the rear frame part is connected to the front frame part and a pair of wheels is provided in the lower part of the rear frame part. A tubular part is fixed to the lower part of the handle, which tubular part is detachably insertable into or over the upper end of the front frame part and in that a lower part of the tubular part is designed for connection to a ferrule when the handle is withdrawn from the front frame part.

14 Claims, 3 Drawing Sheets

(56) References Cited

U.S. PATENT DOCUMENTS

Figure 2:
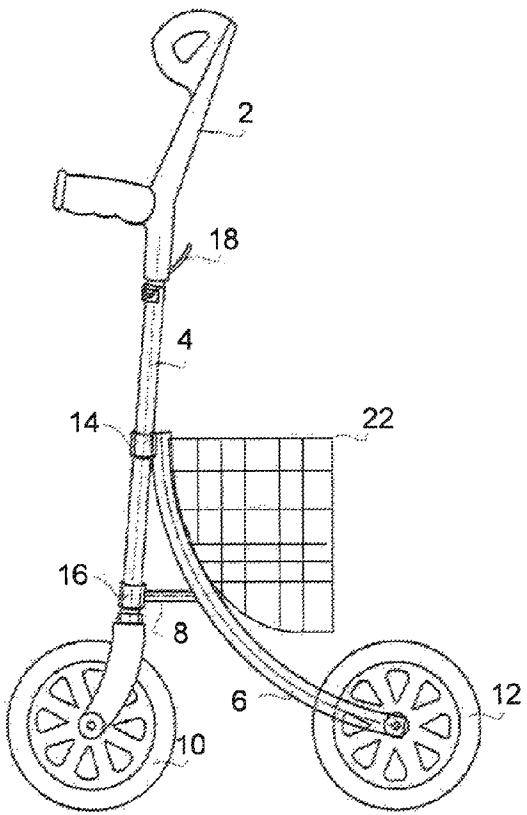

| | | | | |
|---|---|---|---|---|
| 5,647,602 | A * | 7/1997 | Nevin | 280/87.021 |
| 6,217,056 | B1 | 4/2001 | Tsuchie | |
| 6,877,519 | B2 * | 4/2005 | Fink | 135/67 |
| 7,540,527 | B2 * | 6/2009 | Willis et al. | 280/642 |
| 8,020,881 | B2 * | 9/2011 | Stump et al. | 280/87.041 |

OTHER PUBLICATIONS

International Written Opinion corresponding to International Application No. PCT/SE2012/051075 mailed Dec. 17, 2012.

* cited by examiner

CRUTCH WITH WHEELS

CROSS-REFERENCE TO RELATED APPLICATIONS

This application is the US National Phase under 35 USC §371 of International Application No. PCT/SE2012/051075 having an international filing date of Oct. 8, 2012 and which claims priority to Swedish Application No. 1150924-7 filed Oct. 6, 2011.

TECHNICAL FIELD

The present invention relates to a crutch with wheels and particularly a crutch that in one simple operation may be converted to a conventional crutch without any wheels.

BACKGROUND ART

For many persons that, due to illness, repetitive strain injuries or other injuries, have a hard time keeping balance it may be very helpful to use a crutch. However, the problem when using a conventional crutch is that it is hard to carry for example a bag, since one hand is already occupied. To solve this problem it has, for many years, been known to use a walking frame on wheels. One problem with walking frames is that they require a relatively large space, which may make it difficult to maneuver in limited spaces. A walking frame is also relatively expensive and is heavy.

In an attempt to solve the above problems, there are today crutches that have been provided with wheels. These crutches require less space then a walking frame and are sometimes provided with hooks or hangers on which a bag may be hung. The wheels make it easier for a person to maneuver the crutch.

U.S. Pat. No. 4,962,781 discloses a crutch with wheels. The crutch comprises a frame structure having a front frame part, the upper end of which is connected to a handle and the lower end of which is connected to a wheel. A rear frame part is connected to the front frame part and a strut is provided between the front and rear frame part. A pair of wheels is provided at the lower end of the rear frame part. Furthermore, the rear frame part and the strut are hinged such that the crutch is foldable in order to be less bulky during, for example, transport thereof. One disadvantage with this crutch provided with wheels is that there are no means for transporting a bag or the like. There is also a limited usage of this crutch in narrow spaces, for example inside an apartment where instead more traditional crutches are used.

WO 2006/121204 describes a walking aid having a frame structure similar to that disclosed in U.S. Pat. No. 4,962,781, but where a single wheel is connected to the rear frame part instead of a pair of wheels. Also the handle is differently designed than in the U.S. Pat. No. 4,962,781 and is more like the handle of a traditional crutch. The frame structure is provided with a hanger for hanging a bag or the like on the walking aid. Also this walking aid has limited usage in narrow spaces.

Thus, there is a need for a crutch which on the one hand is easy to maneuver and loadable and on the other hand also is usable in narrow spaces.

SUMMARY OF THE INVENTION

The present invention solves the above-noted problem by providing a crutch that is easy to maneuver and which enables the possibility to carry a load and at the same time is usable in narrow spaces. The present invention solves this problem with a crutch provided with wheels that in one simple operation is convertible to a traditional crutch.

This is possible with the wheel provided crutch. The crutch has a frame structure comprising a straight front frame part, a curved rear frame part and a strut provided between the straight front frame part and the curved rear frame part. A handle is provided in the upper part of the front frame part and a wheel is provided in the lower part of the front frame part. The upper part of the rear frame part is connected to the front frame part and a pair of wheels is provided in the lower part of the rear frame part. A tubular part is fixed to the lower part of the handle, which tubular part is detachably insertable into or over the upper end of the front frame part and a lower part of the tubular part is designed for connection to a ferrule when the handle is in an extended state.

According to a preferred embodiment, the ferrule may be connected to the lower part of the tubular part via the front frame part. Furthermore, there may be two holders provided on the rear frame part for holding a basket.

The rear frame part is connected to the front frame part trough a first socket having the shape of a sleeve, through which the front frame part is inserted; and the strut is fixed to the rear frame part and connected to the front frame part by a second socket having the shape of a sleeve, through which the front frame part is inserted.

In a preferred embodiment there is at least one opening provided in the lower part of the front frame part, in which opening a spring biased pin that is provided on the front wheel is insertable in order to secure the wheel to the front frame part. The second socket may be provided with a slot, in which the spring biased pin is insertable in order to secure the wheel to the frame structure.

In another preferred embodiment, openings for height adjustment of the crutch are provided in the tubular part which is connected to the handle and a locking device is provided having peripheral substantially semicircular legs for surrounding the front frame part and a pin adapted to be inserted into an opening in the front frame part and in one of the height adjustment openings.

SHORT DESCRIPTION OF THE DRAWINGS

Figure 1:
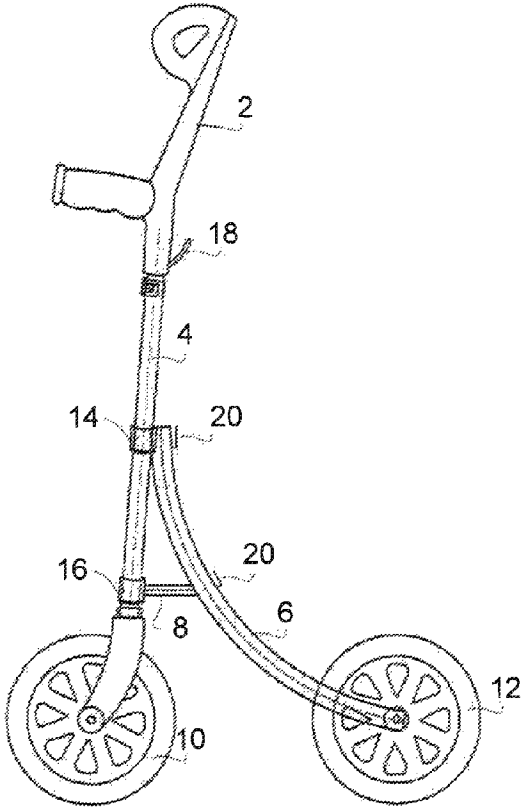
Figure 3:
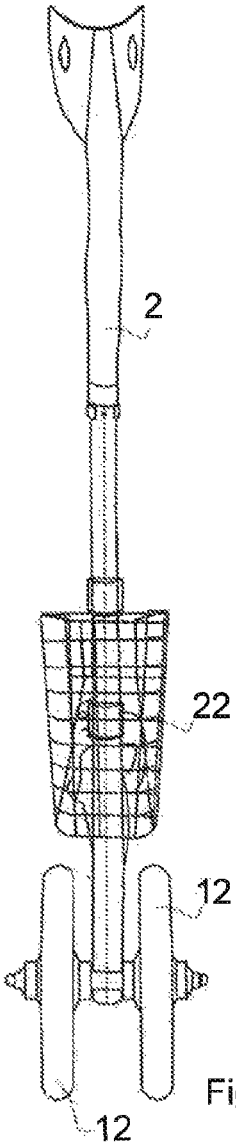
Figure 4:
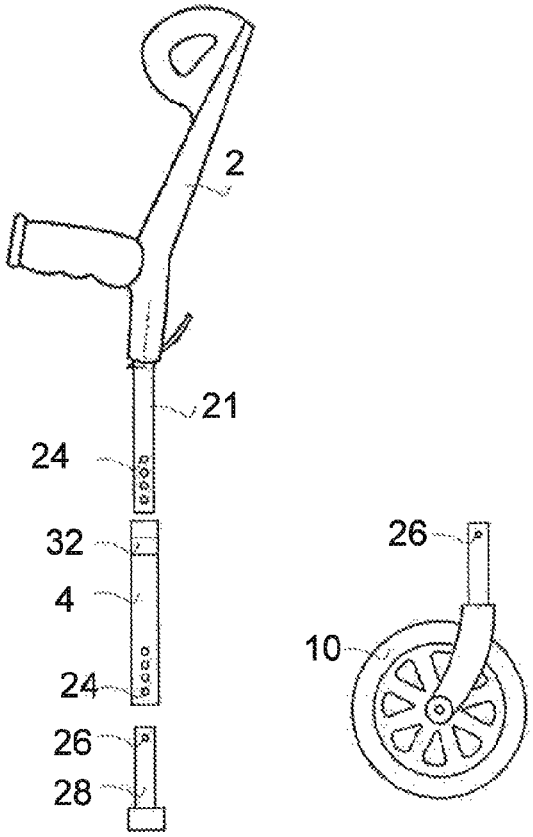
Figure 5:
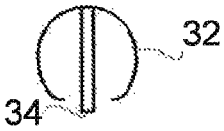
Figure 6:
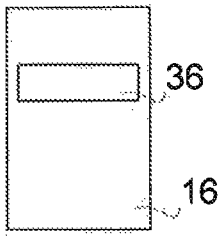
Figure 7:
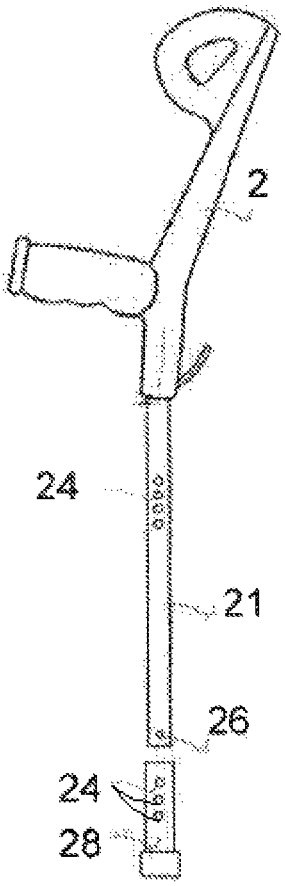

The present invention will be described in detail below, with reference to the attached drawings, which show:

FIG. 1 is a side view of the crutch provided with wheels,

FIG. 2 is another side view of the crutch provided with wheels, which crutch also comprises a basket for a basket load and storage, FIG. 3 is a rear view of the crutch provided with wheels, which clearly shows the two rear wheels, FIG. 4 is a schematic view showing how the crutch provided with wheels may be converted to a traditional crutch, and close up view of the front wheel, FIG. 5 is a schematic view of a locking device for locking the handle to the front frame part of the crutch provided with wheels, FIG. 6 is a detailed view of the second socket for holding and guiding the front frame part, FIG. 7 is yet another schematic view of a second embodiment showing how the crutch provided with wheels may be converted to a traditional crutch.

DETAILED DESCRIPTION OF THE INVENTION

In FIG. 1, a crutch provided with wheels is shown from the side. In conjunction with this description of the crutch, the words lower, upper, front and rear will be used. In this context the word upper part means a part that is directed upwards towards the handle end of the crutch provided with wheels. A lower part is a part that is directed towards the wheels or the ground. A front part is a part that is directed forward in the direction of travel of the crutch and a rear part is directed away from the direction of travel of the crutch.

As is apparent from FIG. 1, the crutch comprises a handle 2 and a frame structure comprising a straight front frame part 4, a curved rear frame part 6 and a strut 8. The strut 8 is provided between the straight front frame part 4 and the curved rear frame part 6 in such a way that the middle of the frame structure has a substantially triangular shape. At the lower part of the handle 2 there is provided a tubular part 21 (see FIG. 4), which tubular part 21, which, in one embodiment, is adapted to be inserted in the upper part of the front frame part 4. In this case the front frame part 4 is hollow and the outer diameter of the tubular part 21 is smaller than inner diameter of the front frame part 4. How the front frame part 4 and the tubular part 21 are secured to each other will be described in more detail in conjunction with FIGS. 4 and 5. In another embodiment, the inner diameter of the tubular part 21 may instead be greater than the outer diameter of the front frame part 4 and may be inserted in or over the front frame part 4. In context of the present invention the word insertable comprises both these embodiments.

In the lower part of the front frame part 4, a wheel 10 is provided. The rear frame part 6 is as mentioned above curved and the curve itself is directed downwards in the frame structure. The upper part of the rear frame part 6 is connected to the front frame part 4. The rear frame part 6 is preferably connected to the middle of the front frame part 4. The rear frame part may, as an example, be welded or a first socket 14 having the shape of a sleeve may be provided in the end of the rear frame part 6, through which sleeve the front frame part 4 is inserted. The advantage with using a sleeve is that the front frame part 4 may be connected with the rear frame part 6 such that it is easy to disengage the front and rear parts from each other. The front frame part 4 and the rear frame part 6 are furthermore connected with each other by the strut 8 in order to make the frame structure more stable. Also the strut 8 is preferably provided with a sleeve or a second socket 16 trough which the front frame part 4 is insertable. The end of the strut 8 that is fixed to the rear frame part 6 is preferably welded to the middle of the curved rear frame part 6. At the lower part of the rear frame part 6, a pair of wheels 12 is provided, as seen in FIG. 3. The use of two wheels 12 at the rear end of the crutch will substantially increase the stability of the crutch and enables the crutch to stand in an upright position by itself, without any support, which is not possible with for example the walking aid, such as disclosed in WO 2006/121404.

By looking at FIG. 1, it is further evident that the rear frame part 6 is provided with two basket holders 20 used to attach a basket 22 to the frame structure. The basket 22 is shown in FIGS. 2 and 3. The basket 22 will make it possible for a user of the crutch to carry a load when the user is walking around with the crutch. It is first and foremost the downwards directed curvature of the rear frame part 6 that makes it possible to have space for a basket. In WO 2006/121404 and U.S. Pat. No. 4,962,781 the frame structure of the crutches disclosed therein limits the possibility to fasten a basket on the crutch, since it would be in the way when accessing the basket. For even more load opportunities a hook 18 is provided on the handle 2 of the crutch. On this hook 18 one may hang a backpack, a bag or the like.

The problem that the present invention solves is the possibility to use crutches provided with wheels in narrow and limited spaces. The present invention solves this by making it possible with one simple operation to convert the crutch provided with wheels to a traditional crutch. This may be done in a numerous of different ways. A first embodiment is shown in FIG. 4.

As mentioned above a tubular part 21 is fixed to the lower part of the handle 2. The tubular part 21 provided with a number of openings 24 which are adapted for engagement with a locking device 32, which is best shown in FIG. 5. Also the front frame part 4 is provided with a number of openings 24 at the lower end and also one opening at the upper end, which is not shown in FIG. 4 since the locking device 32 is inserted therein. Thus, the handle 2 and the front frame part 4 are connected together by inserting the tubular part 21 in the front frame part 4 and is locked by that the pin 34 of locking device 32 is inserted in the upper opening of the front frame part 4 and one of the openings 24. The locking device 32 is spring based, i.e. peripheral substantially semicircular legs of the locking device 32 will "snap-in" around the front frame part 4. The reason why there are several openings provided in the tubular part 21 is that it makes it possible to adjust the height of the crutch. When the crutch is provided with wheels, the front wheel 10 is inserted in the lower part of the front frame part 4. For this purpose the front wheel 10 is provided a tubular part having a spring biased pin 26, which is shown on the right hand side of FIG. 4. The spring biased pin 26 snaps into one of the openings 24 of the front frame part 4 in order to lock the parts to each other, as is known by a person skilled in the art. The spring biased pin 26 will also be used in order to keep the front frame part 4 in place in the first socket 14 and in the second socket 16. The second socket 16, which is shown in detail in FIG. 6, is provided with a slot 36. The spring based pin 26 is long enough to firstly extend through the opening 24 of the front frame part 4 and secondly also through the slot 36 in the second socket 16. Another advantage with this kind of locking mechanism is that the side extension (length) of the slot 36 limits the turning radius of the crutch. The front frame part 4 runs freely in the first socket 14 and the second socket 16 if it is not locked by the spring biased pin and is freely turnable in these sockets. However, the slot 36 limits how much the front frame part 4 is turnable in the sockets. In one extreme case the slot is a single opening, which means that the front wheel cannot be turned.

In those cases where the crutch is to be used as a traditional crutch the spring biased pin 26 may be pressed and the front frame part 4 which is connected to the handle 2 is drawn up and out of the sockets 14 and 16. In order to function as a traditional crutch a ferrule 28 is inserted in the lower part of the front frame part 4. The ferrule 28 is, exactly as the front wheel 10, provided with a spring biased pin 26 such that the ferrule 28 and front frame part 4 may be locked to each other. In order to provide the crutch with wheels again the ferrule 28 is detached and the front frame part 4 is easily inserted into the first socket 14 and the second socket 16 and is locked by the spring biased pin 26. Thus, it is possible to convert the crutch provided with wheels to a traditional crutch in one simple operation. Therefore this crutch has a considerably greater range of application than traditional crutches, walking frames or for example also the above described prior art crutches provided wheels.

In a second embodiment, shown in FIG. 7, the front frame part 4 is permanently fixed to the rear frame part 6, the front wheel 10 and the strut 8. The handle 2 resembles the handle in the first embodiment, but the tubular part 21 is now considerably longer, corresponding to the entire length of the front frame part 4. The tubular part 21 is still provided with several openings 24 in order to adjust the height of the crutch. The tubular part 21 is furthermore provided with a spring biased pin 26 for engagement with the ferrule 28. In this embodiment the ferrule 28 is provided with openings 24 instead of a spring biased pin as in the previous embodiment. The crutch is locked in the same way as in previous embodiment by means of the locking device 32 and will therefore not be described once more.

Different embodiments of the present invention have been described above. However, it should be understood that even if the invention has been described in terms of preferred embodiments the invention is not limited to these. There are many different embodiments and variations which are within the scope of the invention, which is best defined by the attached claims.

The invention claimed is:

1. A crutch provided with wheels comprising a frame structure comprising:

a single straight front frame part, a single curved rear frame part with the curve itself directed downwards in the frame structure, and a strut extending between the straight front frame part and the curved rear frame part; said front frame part and said rear frame part defining a single plane; an upper part of the curved rear frame part being connected to the front frame part;

a handle at an upper part of the front frame part;

a tubular part extending from a lower part of the handle; said tubular part being removably insertable into or over the upper part of the front frame part;

a front wheel at a lower part of the front frame part;

a pair of rear wheels at a lower part of the curved rear frame part; and a ferrule adapted to be operatively and removably connected to said tubular part;

whereby said handle is operatively disconnectable from said front wheel to removably and operatively disconnect said handle from said front wheel to operatively connect said handle to said ferule such that said handle can optionally be used with said ferrule and without said front wheel.

2. The crutch according to claim 1, wherein the tubular part affixed to the handle has a length shorter than the front frame part; the ferrule being removably connectable to the lower part of the tubular part via the front frame part; said front wheel being removably connectable to the front frame part such that said front wheel and ferrule can be interchangeably connected to the lower part of the front frame part.

3. The crutch according to claim 1, wherein two holders are provided on the rear frame part, which holders are adapted for holding a basket.

4. The crutch according to claim 1, wherein the rear frame part is connected to the front frame part through a first socket having the shape of a sleeve, through which the front frame part is inserted.

5. The crutch according to claim 1, wherein the strut is fixed to the rear frame part and connected to the front frame part by a second socket having the shape of a sleeve, through which the front frame part is inserted.

6. The crutch according to claim 1, wherein there is at least one opening provided in the lower part of the front frame part, in which opening a spring biased pin that is provided on the front wheel is insertable in order to secure the wheel to the front frame part.

7. The crutch according to claim 6, wherein a second socket is provided with a slot, in which the spring biased pin is insertable in order to secure the wheel to the frame structure.

8. The crutch according to claim 1, wherein openings for height adjustment of the crutch are provided in the tubular part, which is connected to the handle.

9. The crutch according to claim 8, wherein a locking device is provided to lock said handle and front frame part together by inserting the tubular part in the front frame part, said locking device having peripheral substantially semicircular legs for surrounding the front frame part and a pin adapted to be inserted into an opening in the front frame part and in one of the height adjustment openings.

10. The crutch of claim 1 wherein said rear frame part is removably connected to said front frame part.

11. A crutch provided with wheels comprising:

a frame structure comprising:

a single straight front frame part, a single curved rear frame part, and a strut extending between the straight front frame part and the curved rear frame part; said front frame part and said rear frame part defining a single plane;

a front wheel at a lower part of the front frame part;

a pair of rear wheels at a lower part of the rear frame part;

a handle removably connectable to an upper part of the front frame part;

a tubular part fixed to a lower part of the handle, said tubular part being detachably insertable into or over the upper part of the front frame part to removably connect said handle to said front frame part; and a ferrule operatively removably connectable to a lower part of said tubular part, such that when the ferrule is connected the crutch is usable in narrow spaces.

12. The crutch of claim 11 wherein said front wheel is removably connectable to said lower part of said front frame part; said ferrule being connectable to said lower part of said front frame part.

13. The crutch of claim 12 wherein said rear frame part is removably connected to said front frame part.

14. The crutch of claim 11, wherein said handle is removable from said frame structure; said ferrule being connectable to the lower part of said tubular part when said handle is withdrawn from said frame structure.

* * * * *